US008643455B2

(12) United States Patent
Ogawa et al.

(10) Patent No.: US 8,643,455 B2
(45) Date of Patent: Feb. 4, 2014

(54) COIL COMPONENT

(75) Inventors: Hideki Ogawa, Takasaki (JP); Toshiyuki Yagasaki, Takasaki (JP); Hiroya Shigemoto, Takasaki (JP); Tsuyoshi Matsumoto, Takasaki (JP); Hiroyuki Higuchi, Takasaki (JP); Kiyoshi Tanaka, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 122 days.

(21) Appl. No.: 13/295,774

(22) Filed: Nov. 14, 2011

(65) Prior Publication Data

US 2012/0188040 A1 Jul. 26, 2012

(30) Foreign Application Priority Data

Jan. 21, 2011 (JP) ..... 2011-011213

(51) Int. Cl.

| | |
|---|---|
| ***H01F 27/02*** | (2006.01) |
| ***H01F 38/12*** | (2006.01) |
| ***H01F 27/29*** | (2006.01) |
| ***H01F 27/30*** | (2006.01) |
| ***H01F 17/04*** | (2006.01) |
| ***H01F 27/24*** | (2006.01) |

(52) U.S. Cl.
USPC ..... 336/83; 336/84 M; 336/192; 336/198; 336/221; 336/233

(58) Field of Classification Search
USPC ..... 336/83, 185, 192, 96, 198
See application file for complete search history.

(56) References Cited

U.S. PATENT DOCUMENTS

| | | | | |
|---|---|---|---|---|
| 4,926,151 | A * | 5/1990 | Morinaga | 335/296 |
| 5,003,279 | A * | 3/1991 | Morinaga et al. | 336/192 |
| 6,071,800 | A * | 6/2000 | Shigemoto et al. | 438/612 |
| 7,215,232 | B2 * | 5/2007 | Aoki et al. | 336/83 |
| 2008/0055034 | A1 * | 3/2008 | Tsunemi et al. | 336/83 |
| 2010/0182115 | A1 * | 7/2010 | Huang et al. | 336/83 |

FOREIGN PATENT DOCUMENTS

| | | | |
|---|---|---|---|
| JP | 2002-334807 | A | 11/2002 |
| JP | 2010-034102 | A | 2/2010 |

* cited by examiner

*Primary Examiner* — Elvin G Enad
*Assistant Examiner* — Ronald Hinson
(74) *Attorney, Agent, or Firm* — Law Office Of Katsuhiro Arai

(57) ABSTRACT

As an embodiment, a pair of first conductive films 12, 13 are formed from the side face to the bottom face of the sheet part 11*a* of a magnetic core 11, and one end 14*b* of the conductive wire of the coil 14 and the other end 14*c* of the conductive wire are joined to the side faces 12*a*, 13*a* of the first conductive films 12, 13, respectively. Also, as an embodiment, the joined parts 14*b*1, 14*c*1 are sandwiched by the side faces 12*a*, 13*a* of the first conductive films 12, 13 and the part 15*a* of the magnetic sheath 15 covering the side face of the sheet part 11*a* of the magnetic core 11, wherein the parts of the magnetic sheath 15 covering the joined parts 14*b*1, 14*c*1 are sandwiched by the side faces 12*a*, 13*a* of the first conductive films 12, 13 and the side faces 16*a*, 17*a* of second conductive films 16, 17 as well as the side faces 18*a*, 19*a* of third conductive films 18, 19.

18 Claims, 4 Drawing Sheets

COIL COMPONENT

BACKGROUND

1. Field of the Invention

The present invention relates to a coil component having a structure of a coil placed around the pillar part of a magnetic core.

2. Description of the Related Art

A coil component having a structure of a coil placed around the pillar part of a magnetic core, such as an inductor or choke coil, generally has metal films at the bottom face of the sheet part of the magnetic core where such magnetic films serve as the base for a pair of external terminals, whereas the spiral part of the coil where a conductive wire is spirally wound is placed around the pillar part of the magnetic core in such a way that one end of the conductive wire is bent downward so that it passes over the sheet part of the magnetic core and then the bent part is joined to one metal film via a solder or other joining material, while the other end of the conductive wire is also bent downward so that it passes over the sheet part of the magnetic core and then the bent part is joined to the other metal film via a solder or other joining material (refer to Patent Literatures 1 and 2).

The bent parts at the one end of the conductive wire and other end of the conductive wire are subject to spring-back (a phenomenon where a reactive force generated by the bent part causes the bending angle to increase after bending). If this spring-back occurs when each bent part is joined to each metal film via a solder or other joining material or when the coil component is soldered to a connection pad of a circuit board, etc., the effective height dimension of the coil component may increase due to the effect of spring-back.

One way to resolve this problem is to adopt a structure whereby each bent part is accommodated within a groove formed on each metal film, but this causes the height dimension of the coil component to increase by the depth of the groove formed on each metal film, and in any event this method does not meet the demand for height reduction in recent years.

PATENT LITERATURES

[Patent Literature 1] Japanese Patent Laid-open No. 2002-334807

[Patent Literature 2] Japanese Patent Laid-open No. 2010-034102

SUMMARY

An object of the present invention is to provide a coil component that can reliably reduce height.

To achieve the aforementioned object, the present invention (coil component) comprises:

a magnetic core integrally having a sheet part and a pillar part formed on the top face of the sheet part;

a pair of first conductive films formed from the side face to a bottom face of the sheet part of the magnetic core;

a coil integrally having a spiral part where a conductive wire whose cross-section shape is a rectangle having a long side and a short side is spirally wound, and one end of the conductive wire and other end of the conductive wire are drawn from the spiral part, wherein the spiral part is placed around the pillar part of the magnetic core, and the long side at the one end of the conductive wire is joined to the surface of the side face of the one first conductive film, while the long side at the other end of the conductive wire is joined to the surface of the side face of the other first conductive film;

a magnetic sheath formed so as to cover each of:

the top face of the pillar part and the side face of the sheet part of the magnetic core, surfaces of the side faces of the first conductive films, and surfaces of the spiral part, one end of the conductive wire, the joined part at the one end of the conductive wire, the other end of the conductive wire, and the joined part at the other end of the conductive wire, of the coil;

a pair of second conductive films formed from the side face of the magnetic sheath to the bottom face of the sheet part of the magnetic core, via the bottom face of the magnetic sheath, so that the surfaces of the bottom faces of the first conductive films are covered, respectively; and a pair of third conductive films formed so as to cover surfaces of the respective second conductive films, wherein the one first conductive film, one second conductive film and one third conductive film constitute a first external terminal, while the other first conductive film, other second conductive film and other third conductive film constitute a second external terminal;

wherein the joined part at the one end of the conductive wire and the joined part at the other end of the conductive wire of the coil are sandwiched by the side faces of the first conductive films and a part of the magnetic sheath covering the side face of the sheet part of the magnetic core, respectively; and wherein the parts of the magnetic sheath covering the surface of the joined part at the one end of the conductive wire and the surface of the joined part at the other end of the conductive wire of the coil are sandwiched, with each joined part in between, by the side face of each of the first conductive films and the side face of each of the second conductive films as well as the side face of each of the third conductive films, respectively.

According to the present invention, the pair of first conductive films are formed from the side face to bottom face of the sheet part of the magnetic core, while the one end of the conductive wire of the coil is joined to the surface of the side face of the one first conductive film while the other end of the conductive wire is joined to the surface of the side face of the other first conductive film. In other words, by accommodating the one end of the conductive wire and the other end of the conductive wire of the coil within the coil component, the height dimension of the coil component can be fixed and the height of the coil component can be reduced reliably.

In addition, the joined part at the one end of the conductive wire and joined part at the other end of the conductive wire of the coil are sandwiched by the side faces of the first conductive films and a part of the magnetic sheath covering the side face of the sheet part of the magnetic core, respectively, and furthermore parts of the magnetic sheath covering the surface of the joined part at the one end of the conductive wire and surface of the joined part at the other end of the conductive wire of the coil are sandwiched, with each joined part in between, by the side face of each of the first conductive films and side face of each of the second conductive films as well as side face of each of the third conductive films, respectively. This means that the former and latter sandwiching structures increase the pressing force of the joined part at the one end of the conductive wire and joined part at the other end of the conductive wire of the coil, against the side faces of the first conductive films, and therefore even if the one end of the conductive wire of the coil and its joined part or the other end of the conductive wire and its joined part undergo thermal expansion or contraction due to thermal effect when the coil component is soldered to a connection pad of a circuit board, etc., displacement by such thermal expansion or contraction of the joined part at the one end of the conductive wire or the joined part at the other end of the conductive wire can be reliably suppressed and therefore each joined part can be kept in a good connected condition.

The aforementioned purpose and other purposes, constitutions/characteristics and operations/effects of the present invention are revealed by the following explanations and attached drawings.

DESCRIPTION OF THE SYMBOLS

Figure 1:
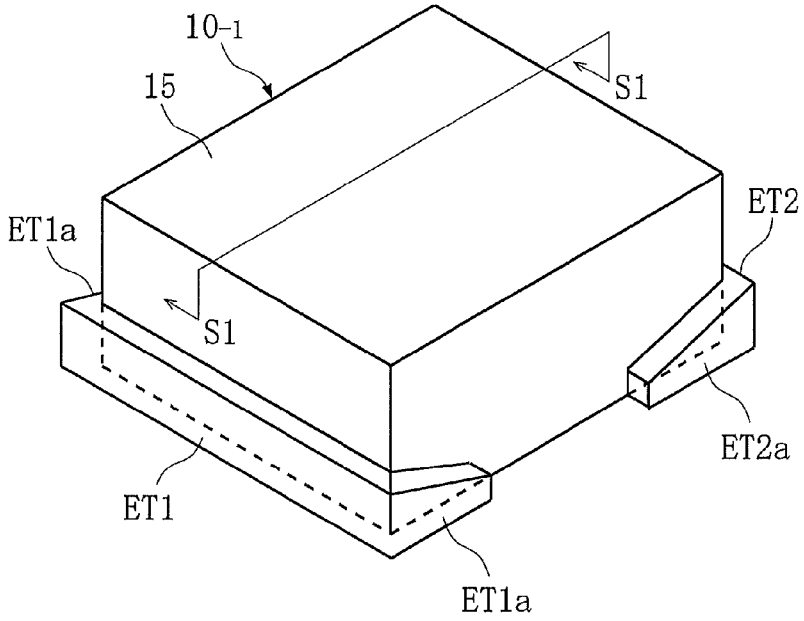
FIG. 1 is a perspective external view of a coil component to which the present invention is applied (Embodiment 1).

10-1, 10-2, 10-3, 10-4 - - - Coil component
11 - - - Magnetic core
12, 13 - - - First conductive film
14 - - - Coil
15 - - - Magnetic sheath
16, 17 - - - Second conductive film
18, 19 - - - Third conductive film
ET1 - - - First external terminal
ET2 - - - Second external terminal.

DETAILED DESCRIPTION

Embodiment 1

Figure 2:
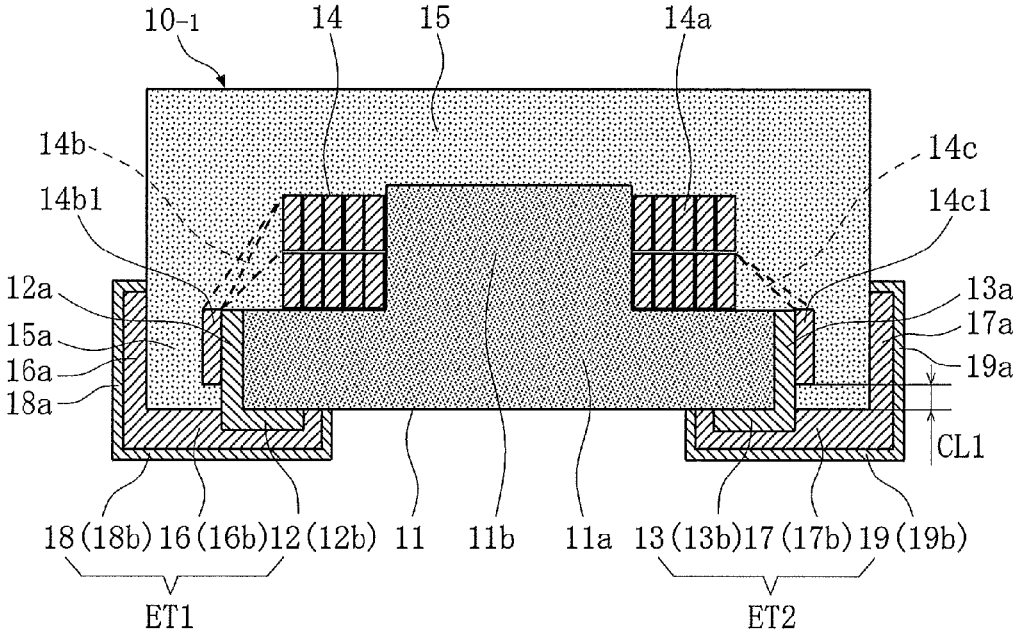
FIG. 2 is an enlarged section view of the coil component shown in FIG. 1, cut along line S1-S1.

FIGS. 1 to 4 show a coil component to which the present invention is applied (Embodiment 1). First, FIGS. 1 to 4 are used to explain the constitution of this coil component 10-1. For the purpose of explanation, top, bottom, left, right, front and rear of FIG. 2 are referred to as top, bottom, front, rear, left and right, respectively, and the same applies to the corresponding directions of FIGS. 1 and 3.

Figure 3:
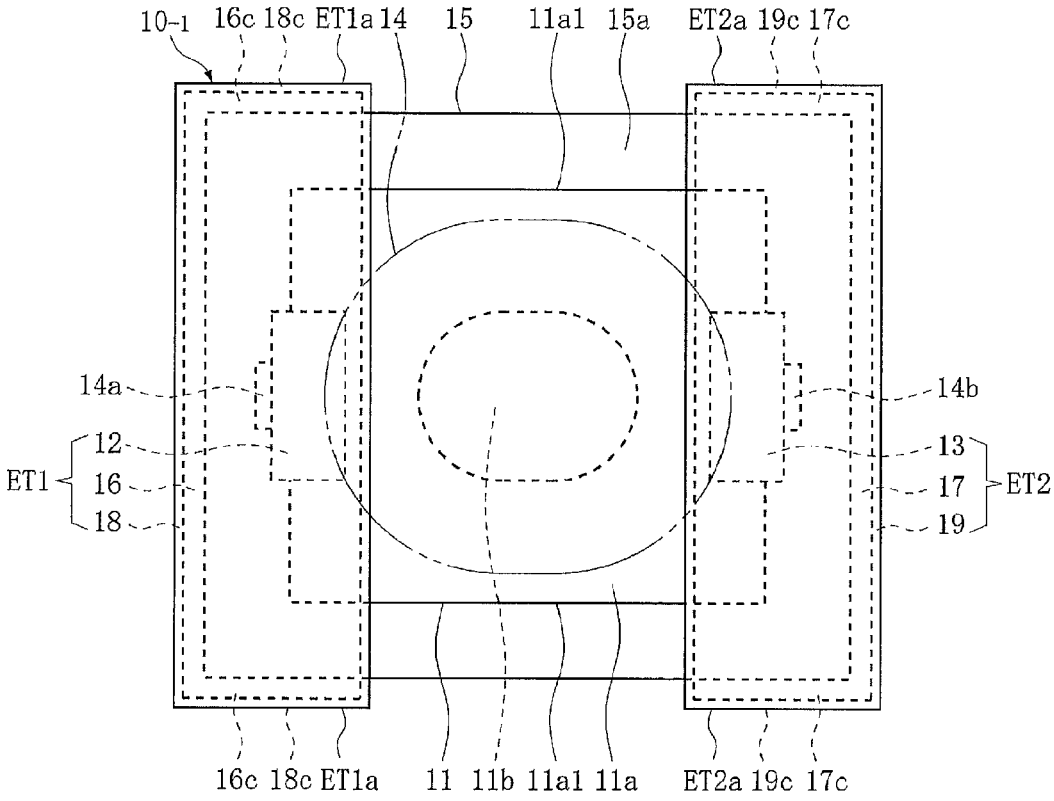
FIG. 3 is an enlarged bottom view of the coil component shown in FIG. 1.

The coil component 10-1 shown in FIGS. 1 to 3 has a magnetic core 11, a pair of first conductive films 12, 13, a coil 14, a magnetic sheath 15, a pair of second conductive films 16, 17 and a pair of third conductive films 18, 19. The size of this coil component 10-1 is, for example, 2.5 mm in front-rear dimension, 2.0 mm in left-right dimension, and 1.0 mm in top-bottom dimension.

Figure 4:
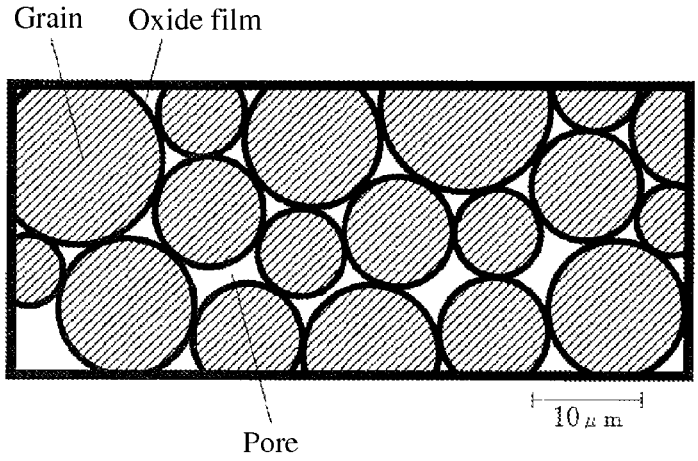
FIG. 4 is a schematic view of a grain condition of the magnetic core shown in FIG. 1, according to an image obtained by observing the core with a transmission electron microscope

The magnetic core 11 integrally has a sheet part 11*a* having a profile, as viewed from the bottom, of a rough rectangle as well as a specific thickness (such as 0.24 mm when the top-bottom dimension is 1.0 mm), and a pillar part 11*b* provided on the top face of the sheet part 11*a* and having a profile, as viewed from the top, of a rough oval as well as a specific height. This magnetic core 11 is constituted by magnetic alloy grains (a group of many magnetic alloy grains) and, as shown in FIG. 4, an oxide film (=insulation film) of magnetic alloy grain is formed on the surface of each magnetic alloy grain and this oxide film ensures bonding of adjacent magnetic alloy grains as well as insulation between adjacent magnetic alloy grains. The magnetic core 11 is formed by die-shaping a magnetic paste containing magnetic alloy grains, solvent and binder at a specific mass ratio, and then heat-treating the shaped paste in an oxidizing ambience to remove the solvent and binder where an oxide film is formed on the surface of each magnetic alloy grain in the heat treatment process. In other words, the magnetic core 11 contains many magnetic alloy grains, oxide film formed on the surface of each magnetic alloy grain, and pores present between those magnetic alloy grains with an oxide film formed on surface. The magnetic alloy grain is specifically a Fe—Cr—Si alloy, Fe—Si—Al alloy, etc., where a desired d50 (median diameter) of the magnetic alloy grain by volume is 3 to 20 μm, while a desired content of magnetic alloy grains in magnetic paste is 85 to 95 percent by weight.

FIG. 4 schematically represents a grain condition of the magnetic core 11, according to an image obtained by observing it with a transmission electron microscope, after creating the magnetic core 11 using Fe—Cr—Si alloy grains whose d50 (median diameter) is 10 μm. Although each magnetic alloy grain is not a perfect sphere in reality, all magnetic alloy grains are depicted as spheres in order to show the grain diameter distribution. Also, while the actual thickness of the oxide film at the surface of each magnetic alloy grain varies in a range of 0.05 to 0.2 μm, all grains are depicted as having a uniform film thickness in order to show that an oxide film is present on each magnetic alloy grain. It should also be noted that, with magnetic alloy grains of Fe—Cr—Si alloy, the oxide film was confirmed to contain the magnetic body $Fe_3O_4$ as well as non-magnetic bodies $Fe_2O_3$ and $Cr_2O_3$.

Note that, while the aforementioned oxide film was obtained by oxidizing elements contained in magnetic alloy grains in the heat treatment process, a substance that would produce an oxide film in the heat treatment process may be added to the magnetic paste, or a glass component that would produce an insulation film similar to oxide film in the heat treatment process may be added to the magnetic paste.

The one first conductive film 12 is formed from the top edge at the center on the front side face of the sheet part 11*a* of the magnetic core 11 to the bottom front, while the other first conductive film 13 is formed from the top edge at the center on the rear side face of the sheet part 11*a* of the magnetic core 11 to the bottom rear. The left-right dimensions (width dimensions) of the first conductive films 12, 13 are smaller than the left-right dimensions (width dimensions) of the front side face and rear side face of the sheet part 11*a* of the magnetic core 11. The first conductive films 12, 13 are created by applying a conductive paste containing metal grains, solvent and binder at a specific mass ratio and then baking the conductive paste to remove the solvent and binder. The metal grain is specifically an Ag or Pd grain, etc., where a desired d50 (median diameter) of the metal grain by volume is 3 to 20 μm, while a desired content of metal grains in magnetic paste is 85 to 95 percent by weight. In other words, since the first conductive films 12, 13 are baked conductive films offering excellent heat resistance and which do not contain resin component, etc., any subsequent heat treatment (for example, heat treatment applied when the one end 14*b* of the conductive wire or the other end 14*c* of the conductive wire is joined, heat treatment applied when the magnetic sheath 15 is created, or heat treatment applied when the second conductive films 16, 17 are created) will not cause degradation, position shift or other changes to the first conductive films 12, 13 during the heat treatment and good adhesion between the first conductive films 12, 13 and magnetic core 11 can also be maintained.

The coil 14 integrally has a spiral part 14*a* where a conductive wire is spirally wound, and one end 14*b* of the conductive wire and the other end 14*c* of the conductive wire drawn from the spiral part 14*a*. The conductive wire used for this coil 14 is a so-called rectangular wire (conductive wire whose cross-section shape is a rectangle having a long side and short side), and the spiral part 14*a* is wound in the flatwise direction according to the alpha winding method. The conductive wire may comprise a Cu, Ag or other metal wire (Cu is desirable from the viewpoint of costs) and an insulation film covering the metal wire, or preferably, a metal wire, an insulation film covering the metal wire and a heat-seal film covering the insulation film, where the heat-seal film interconnects parts of the conductive wire constituting the spiral part 14*a*. The spiral part 14*a* is placed around the pillar part 11*b* of the magnetic core 11, where the placement method includes creating the coil 14 separately and fitting the spiral part 14*a* into the pillar part 11*b*, or directly winding the conductive wire around the pillar part 11*b* to form the spiral part 14*a*. Also at the tip of the one end 14*b* of the conductive wire, the insulation layer and heat-seal layer covering the tip are removed and then the surface on the long side is electrically connected to the surface of the side face 12*a* of the one first conductive film 12 via diffusion bonding (heat-seal joining), while at the tip of the other end 14*c* of the conductive wire, the insulation layer and heat-seal layer covering the tip are removed and then the surface on the long side is electrically connected to the surface of the side face 13*a* of the other first conductive film 13 via diffusion bonding (heat-seal joining). As mentioned above, the first conductive films 12, 13 are baked conductive films offering excellent heat resistance, so any heat treatment that may be applied when the one end 14*b* of the conductive wire or the other end 14*c* of the conductive wire is joined will not cause degradation, position shift or other changes to the first conductive films 12, 13 during the heat treatment and the first conductive films 12, 13 and the one end 14*b* of the conductive wire or the other end 14*c* of the conductive wire can be joined in a favorable manner.

The top-bottom dimension of the joined part 14*b*1 at the one end 14*b* of the conductive wire and top-bottom dimension of the joined part 14*c*1 at the other end 14*c* of the conductive wire may be the same as the thickness of the sheet part 11*a* of the magnetic core 11, but as shown in FIG. 2, it is better to provide a clearance CL1 between the bottom edges of joined parts 14*b*1, 14*c*1 and the bottom face of the sheet part 11*a* because an area where a part of the magnetic sheath 15 has wrapped around can be formed below the joined parts 14*b*1, 14*c*1. Also, the number of windings of the spiral part 14*a* and cross-section area of the metal wire constituting the conductive wire are specified, as appropriate, according to the inductance, rated current and other characteristic values required of the coil component 10-1.

The magnetic sheath 15 has a profile, as viewed from the top, of a rough rectangle and is formed in such a way as to cover the top face of the pillar part 11*b* and the side face of the sheet part 11*a* of the magnetic core 11, surfaces of the side faces 12*a*, 13*a* of the first conductive films 12, 13, and surfaces of the spiral part 14*a*, one end 14*b* of the conductive wire and the joined part 14*b*1 at the one end 14*b* of the conductive wire, as well as the other end 14*c* of the conductive wire and the joined part 14*c*1 at the other end 14*c* of the conductive wire, of the coil 14, and the bottom face of the sheath is roughly flush with the bottom face of the pillar part 11*b* of the magnetic core 11. This magnetic sheath 15 is constituted by magnetic alloy grains and insulation material present between the magnetic alloy grains, wherein this insulation material ensures bonding of adjacent magnetic alloy grains as well as insulation between these adjacent magnetic alloy grains. The magnetic sheath 15 is formed by die-shaping a magnetic paste containing magnetic alloy grains and thermo-setting insulation material at a specific mass ratio and then heat-treating the shaped paste to harden the insulation material. The magnetic alloy grain is specifically a Fe—Cr—Si alloy, Fe—Si—Al alloy, etc., where a desired d50 (median diameter) of the magnetic alloy grain by volume is 3 to 20 μm, while a desired content of magnetic alloy grains in magnetic paste is 85 to 95 percent by weight. For the thermo-setting insulation material contained in the magnetic paste, epoxy resin, phenol resin, polyester, etc., is a desired choice. Since the magnetic sheath 15 contains an insulation material constituted by epoxy resin, etc., sufficient adhesion with the magnetic core 11, first conductive films 12, 13 and the coil 14 can be ensured by this insulation material.

The one second conductive film 16 is formed from the front side face of the magnetic sheath 15 to the bottom face of the sheet part 11*a* of the magnetic core 11 via the bottom face of the magnetic sheath 15, in a manner covering the surface of the bottom face 12*a* of the one first conductive film 12, while the other second conductive film 17 is formed from the rear side face of the magnetic sheath 15 to the bottom face of the sheet part 11*a* of the magnetic core 11 via the bottom face of the magnetic sheath 15, in a manner covering the surface of the bottom face 13*a* of the other first conductive film 13. As shown in FIG. 2, the top-edge heights of the side faces 16*a*, 17*a* of the second conductive films 16, 17 are slightly higher than the top-face height of the sheet part 11*a* of the magnetic core 11. Also note that the one second conductive film 16 has a left-right dimension (width dimension) roughly the same as that of the front side face of the magnetic sheath 15, while the other second conductive film 17 has a left-right dimension (width dimension) roughly the same as that of the rear side face of the magnetic sheath 15. Furthermore, a side face 16*a* and bottom face 16*b* of the one second conductive film 16 are continued via a second side face 16*c* at the left side face and right side face of the magnetic sheath 15, while a side face 17*a* and bottom face 17*b* of the other second conductive film 17 are continued via a second side face 17*c* at the left side face and right side face of the magnetic sheath 15. These second conductive films 16, 17 are constituted by metal grains and insulation material present between these metal grains, wherein some metal grains contained in the one second conductive film 16 are electrically connected to the one first conductive film 12, while some metal grains contained in the other second conductive film 17 are electrically connected to the other first conductive film 13. The second conductive films 16, 17 are formed by applying a conductive paste containing metal grains and thermo-setting insulation material at a specific mass ratio and then heat-treating the applied paste to harden the insulation material. The metal grain is specifically an Ag or Pd grain, etc., where a desired d50 (median diameter) of the metal grain by volume is 3 to 20 μm, while a desired content of metal grains in magnetic paste is 80 to 90 percent by weight. For the thermo-setting insulation material contained in the conductive paste, epoxy resin, phenol resin, polyester, etc., is a desired choice. Since the second conductive films 16, 17 contain an insulation material constituted by epoxy resin, etc., sufficient adhesion with the magnetic sheath 15, first conductive films 12, 13 and the magnetic core 11 can be ensured by this insulation material.

The one third conductive film 18 is formed in a manner covering the surface of the one second conductive film 16, while the other third conductive film 19 is formed in a manner covering the surface of the other second conductive film 17. In other words, the one third conductive film 18 has a side face 18*a* corresponding to the side face 16*a* of the one second conductive film 16, a bottom face 18*b* corresponding to the bottom face 16*b*, and a second side face 18*c* corresponding to the second side face 16*c*, while the other third conductive film 19 has a side face 19*a* corresponding to the side face 17*a* of the other second conductive film 17, a bottom face 19*b* corresponding to the bottom face 17*b*, and a second side face 19*c* corresponding to the second side face 17*c*, and accordingly, as with the second conductive films 16, 17, the one third conductive film 18 has a left-right dimension (width dimension) roughly the same as that of the front side face of the magnetic sheath 15, while the other third conductive film 19 has a left-right dimension (width dimension) roughly the same as that of the rear side face of the magnetic sheath 15. The third conductive films 18, 19 are formed by electroplating or other thin-film forming method. These third conductive films 18, 19 are formed by at least one layer of metal film, wherein the one third conductive film 18 is electrically connected to some metal grains contained in the one second conductive film 16, while the other third conductive film 19 is electrically connected to some metal grains contained in the other second conductive film 17. A desirable mode of the third conductive films 18, 19 is a two-layer structure comprising a Ni film and a Sn film covering the surface of the Ni film, but the number of layers and materials constituting the layers are not specifically limited as long as connection to the second conductive films 17, 18 can be made in a favorable manner and the coil component 10-1 can be mounted on a circuit board, etc., or specifically soldered to a connection pad in a favorable manner.

With the aforementioned coil component 10-1, the one first conductive film 12, one second conductive film 16 and one third conductive film 18 constitute a first external terminal ET1, while the other first conductive film 13, other second conductive film 17 and other third conductive film 19 constitute a second external terminal ET2. In addition, the second side face 16*c* of the one second conductive film 16 and second side face 18*c* of the one third conductive film 18 constitute two wraparound parts ET1*a* on the first external terminal ET1, while the second side face 17*c* of the other second conductive film 17 and second side face 19*c* of the other third conductive film 19 constitute two wraparound parts ET2*a* on the second external terminal ET2.

Also with the aforementioned coil component 10-1, the joined part 14*b*1 at the one end 14*b* of the conductive wire of the coil 14 is sandwiched by the side face 12*a* of the one first conductive film 12 and a part 15*a* of the magnetic sheath 15 covering the side face of the sheet part 11*a* of the magnetic core 11, and furthermore a part (no reference numeral) of the magnetic sheath 15 covering the surface of the joined part 14*b*1 at the one end 14*b* of the conductive wire of the coil 14 is sandwiched, with the joined part 14*b*1 in between, by the side face 12*a* of the one first conductive film 12 and the side face 16*a* of the one second conductive film 16 as well as the side face 18*a* of the one third conductive film 18. Similarly, the joined part 14*c*1 at the other end 14*c* of the conductive wire of the coil 14 is sandwiched by the side face 13*a* of the other first conductive film 13 and the part 15*a* of the magnetic sheath 15 covering the side face of the sheet part 11*a* of the magnetic core 11, and furthermore a part (no reference numeral) of the magnetic sheath 15 covering the surface of the joined part 14*c*1 at the other end 14*c* of the conductive wire of the coil 14 is sandwiched, with the joined part 14*c*1 in between, by the side face 13*a* of the other first conductive film 13 and the side face 17*a* of the other second conductive film 17 as well as the side face 19*a* of the other third conductive film 19.

Next, an example of desired manufacturing method for the aforementioned coil component 10-1 is explained.

For the magnetic core 11, a magnetic paste containing 85 percent by weight of Fe—Cr—Si alloy grains whose d50 (median diameter) is 10 μm, 13 percent by weight of butyl carbitol (solvent) and 2 percent by weight of polyvinyl butyral (binder) is prepared, and this magnetic paste is shaped using dies and a press machine, after which the shaped paste is heat-treated in the atmosphere for 2 hours at 750° C. to remove the solvent and binder, while an oxide film of magnetic alloy grain is formed on each magnetic alloy grain, to create the magnetic core 11.

Next, for the first conductive films 12, 13, a conductive paste containing 85 percent by weight of Ag grains whose d50 (median diameter) is 5 μm, 13 percent by weight of butyl carbitol (solvent) and 2 percent by weight of polyvinyl butyral (binder) is prepared, and this conductive paste is applied to the magnetic core 11 using a roller coater, after which the applied paste is baked in the atmosphere for 1 hour at 650° C. to remove the solvent and binder, to create the first conductive films 12, 13.

Next, the separately prepared spiral part 14*a* of the coil 14 is fitted into the pillar part 11*b* of the magnetic core 11, and the tip of the one end 14*b* of the conductive wire of the coil 14 (the insulation layer and heat-seal layer have been already removed) is joined to the surface of the side face 12*a* of the one first conductive film 12 by means of diffusion bonding (heat-seal joining), while the tip of the other end 14*c* of the conductive wire of the coil 14 (the insulation layer and heat-seal layer have been already removed) is joined to the surface of the side face 13*a* of the other first conductive film 13 by means of diffusion bonding (heat-seal joining).

Next, for the magnetic sheath 15, a magnetic paste containing 90 percent by weight of Fe—Cr—Si alloy grains whose d50 (median diameter) is 10 μm and 10 percent by weight of epoxy resin is prepared, and this magnetic paste is shaped using dies and a press machine for the magnetic core 11 where the coil 14 is placed, after which the shaped paste is heat-treated in the atmosphere for 1 hour at 180° C. to harden the epoxy resin, to create the magnetic sheath 15.

Next, for the second conductive films 16, 17, a conductive paste containing 80 percent by weight of Ag grains whose d50 (median diameter) is 5 μm and 20 percent by weight of epoxy resin is prepared, and this conductive paste is applied to the magnetic core 11 and magnetic sheath 15 using a roller coater, after which the applied paste is heat-treated for 1 hour at 150° C. to harden the epoxy resin, to create the second conductive films 16, 17.

Next, the created second conductive films 16, 17 are introduced to a Ni electroplating bath to form a Ni film on the surface of second conductive films 16, 17, after which the Ni-covered films are introduced to a Sn electroplating bath to form a Sn film on the surface of each Ni film, to create the third conductive films 18, 19.

Next, the effects of the aforementioned coil component 10-1 are explained.

<Effect 1> With the aforementioned coil component 10-1, the pair of first conductive films 12, 13 are formed from the side face to the bottom face of the sheet part 11*a* of the magnetic core 11, and the one end 14*b* of the conductive wire of the coil 14 is joined to the surface of the side face 12*a* of the one first conductive film 12, while the other end 14*c* of the conductive wire is joined to the surface of the side face 13*a* of the other first conductive film 13. In other words, by accommodating the one end 14*b* of the conductive wire and the other end 14*c* of the conductive wire of the coil 14 within the coil component 10-1, the height dimension of the coil component 10-1 can be fixed and the height of the coil component 10-1 can be reduced reliably.

Also with the aforementioned coil component 10-1, the joined part 14*b*1 at the one end 14*b* of the conductive wire of the coil 14 and the joined part 14*c*1 at the other end 14*c* of the conductive wire are sandwiched by the side faces 12*a*, 13*a* of the first conductive films 12, 13 and the part 15*a* of the magnetic sheath 15 covering the side face of the sheet part 11*a* of the magnetic core 11, respectively, and furthermore the part (no reference numeral) of the magnetic sheath 15 covering the surface of the joined part 14*b*1 at the one end 14*b* of the conductive wire of the coil 14 and the part (no reference numeral) covering the surface of the joined part 14*c*1 at the other end 14*c* of the conductive wire are sandwiched, with the joined parts 14*b*1, 14*c*1 in between, by the side faces 12*a*, 13*a* of the first conductive films 12, 13 and side faces 16*a*, 17*a* of the second conductive films 16, 17 as well as side faces 18*a*, 19*a* of the third conductive films 18, 19, respectively. This means that the former and latter sandwiching structures increase the pressing force of the joined part 14*b*1 at the one end 14*b* of the conductive wire of the coil 14 and the joined part 14*c*1 at the other end 14*c* of the conductive wire, against the side faces 12*a*, 13*a* of the first conductive films 12, 13, and therefore even if the one end 14*b* of the conductive wire of the coil 14 and its joined part 14*b*1 or the other end 14*c* of the conductive wire and its joined part 14*c*1 undergo thermal expansion or contraction due to thermal effect when the coil component 10-1 is soldered to a connection pad of a circuit board, etc., displacement by such thermal expansion or contraction of the joined part 14*b*1 at the one end 14*b* of the conductive wire or the joined part 14*c*1 at the other end 14*c* of the conductive wire can be reliably suppressed and therefore each joined part 14*b*1, 14*c*1 can be kept in a good connected condition.

<Effect 2> With the aforementioned coil component 10-1, the second conductive films 16, 17 have left-right dimensions (width dimensions) roughly the same as those of the front side face and rear side face of the magnetic sheath 15, while the third conductive films 18, 19 covering the second conductive films 16, 17 also have similar left-right dimensions (width dimensions). In other words, the widely formed side faces 16*a*, 17*a* of the second conductive films 16, 17 and side faces of 18*a*, 19*a* of the third conductive films 18, 19 can be utilized to increase the corresponding sandwiching forces so that connected conditions at each joined part 14*b*1, 14*c*1 can further preferably be maintained. Furthermore, sufficient contact areas between the second conductive films 16, 17 and the magnetic core 11 and magnetic sheath 15 are ensured and adhesion forces are increased, thereby reliably preventing the second conductive films 16, 17 and third conductive films from peeling or detaching from the coil component 10-1.

<Effect 3> With the aforementioned coil component 10-1, the second side face 16*c* of the one second conductive film 16 and the second side face 18*c* of the one third conductive film 18 constitute the two wraparound parts ET1*a* on the first external terminal ET1, while the second side face 17*c* of the other second conductive film 17 and the second side face 19*c* of the other third conductive film 19 constitute the two wraparound parts ET2*a* on the second external terminal ET2. This increases the contact areas of the second conductive films 16, 17 with respect to the magnetic sheath 15 as well as the corresponding adhesion forces, which more reliably prevents the second conductive films 16, 17 and third conductive films from peeling or detaching from the coil component 10-1.

<Effect 4> With the aforementioned coil component 10-1, the magnetic core 11 is constituted by magnetic alloy grains, where an oxide film of magnetic alloy grains is formed on the surface of each magnetic alloy grain and this oxide film binds adjacent magnetic alloy grains. In other words, because the oxide film present on the surface of each magnetic alloy grain ensures insulation of adjacent magnetic alloy grains, sufficient volume resistivity can be ensured for the magnetic core 11 even when magnetic alloy grains made of low volume resistivity material are used, and the natural high magnetic permeability of magnetic alloy grains can be fully utilized. This suppresses the magnetic saturation of the coil component 10-1 to improve the direct-current bias characteristics and also contributes significantly to electrical current amplification (higher rated current).

<Effect 5> With the aforementioned coil component 10-1, the magnetic sheath 15 is constituted by magnetic alloy grains and insulation material present between these magnetic alloy grains, and this insulation material binds adjacent magnetic alloy grains. Since the insulation material present between magnetic alloy grains ensures insulation of adjacent magnetic alloy grains, sufficient volume resistivity can be ensured for the magnetic sheath 15 even when magnetic alloy grains made of low volume resistivity material are used, and the natural high magnetic permeability of magnetic alloy grains can be fully utilized. This suppresses the magnetic saturation of the coil component 10-1 to improve the direct-current bias characteristics and also contributes significantly to electrical current amplification (higher rated current).

<Effect 6> With the aforementioned coil component 10-1, the bottom face of the pillar part 11*b* of the magnetic core 11 is roughly flush with the bottom face of the magnetic sheath 15. The coil component 10-1 is placed in a bulk state in a soft bag, hard case or other container while in distribution and put in a bulk state in the storage chamber of the feeder for mounting, and therefore components often bump against one another during distribution and when mounting. Since the bottom face of the pillar part 11*b* of the magnetic core 11 is roughly flush with the bottom face of the magnetic sheath 15, however, bumping of components will not cause damage to two areas 11*a*1 (refer to FIG. 3) not covered by the first external terminal ET1 and the second external terminal ET2, along the outer periphery of the bottom face of the sheet part 11*a* of the magnetic core 11. This means that, although damage to these two areas 11*a*1 may cause the oxide film to peel from the surface of magnetic alloy grains present in each area 11*a*1 and insulation property of adjacent magnetic alloys to drop, such phenomenon can be reliably prevented because the bottom face of the pillar part 11*b* of the magnetic core 11 is roughly flush with the bottom face of the magnetic sheath 15, and any concerns for short-circuiting of the first external terminal ET1 and the second external terminal ET2 in the event of occurrence of the aforementioned phenomenon can also be eliminated.

Embodiment 2

Figure 5:
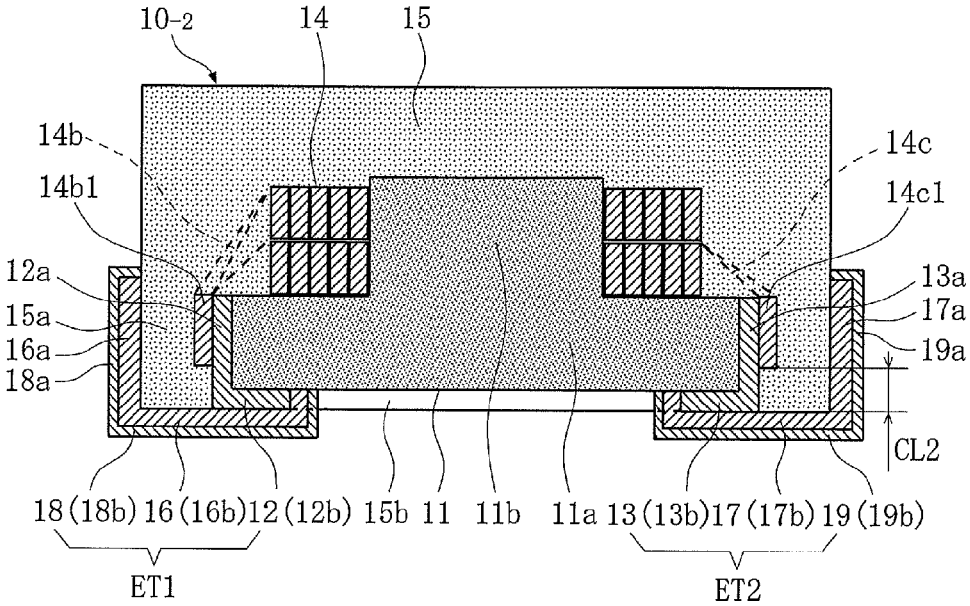
FIG. 5 is a section view, corresponding to FIG. 2, of a coil component to which the present invention is applied (Embodiment 2).
Figure 6:
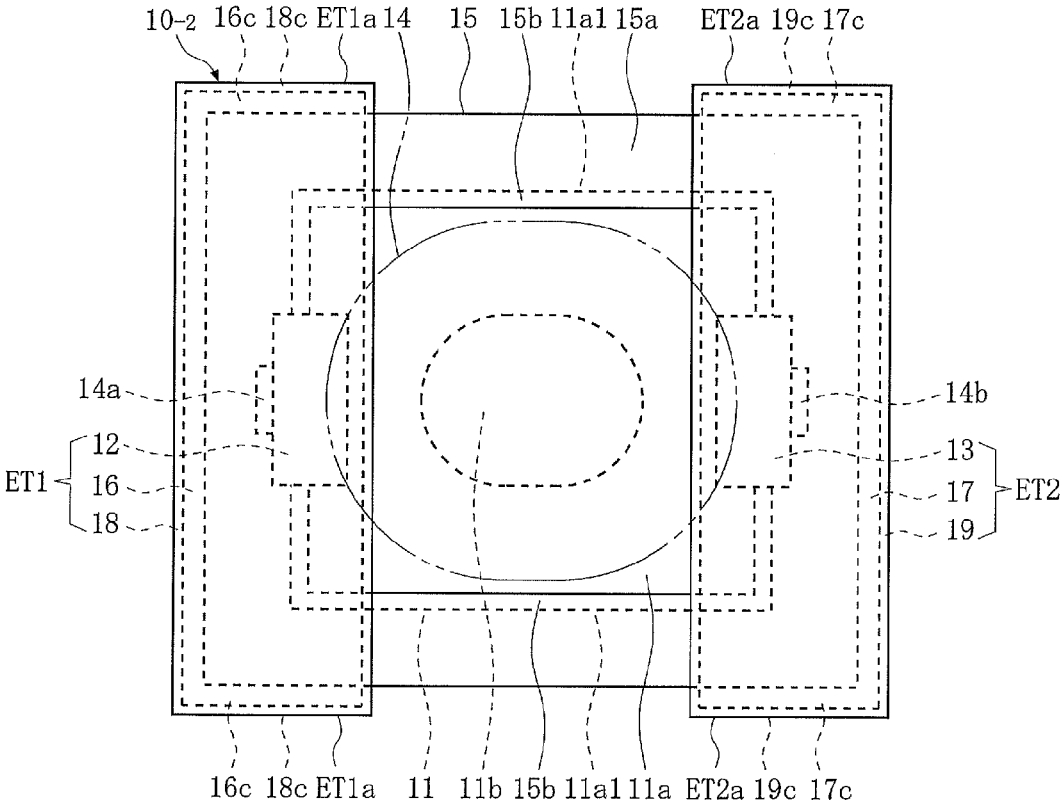
FIG. 6 is an enlarged bottom view, corresponding to FIG. 3, of the coil component shown in FIG. 5

FIGS. 5 and 6 show a coil component to which the present invention is applied (Embodiment 2). This coil component 10-2 is different from the coil component 10-1 in Embodiment 1 in that:

Along the outer periphery of the bottom face of the sheet part 11*a* of the magnetic core 11, the two areas 11*a*1 not covered by the first external terminal ET1 and the second external terminal ET2 are entirely covered by a part 15*b* extending downward from the part 15*a* of the magnetic sheath 15 covering the side face of the sheet part 11*a* of the magnetic core 11.

The remainder of the constitution is the same as that of the coil component 10-1 in Embodiment 1 and therefore not explained.

This coil component 10-2 achieves <Effect 7> below in addition to <Effect 1> to <Effect 5> mentioned above.

<Effect 7> By actively and entirely covering, by the downward extension part 15*b* of the magnetic sheath 15, the two areas 11*a*1 not covered by the first external terminal ET1 and the second external terminal ET2 along the outer periphery of the bottom face of the sheet part 11*a* of the magnetic core 11, damage to the two areas 11*a*1 mentioned in <Effect 6> can be reliably prevented and drop in insulation property and short-circuiting caused by such damage can also be prevented more reliably.

Note that, although FIGS. 5 and 6 show the entirety of the areas not covered by the first conductive films 12, 13 along the outer periphery of the bottom face of the sheet part 11*a* of the magnetic core 11, but which is covered by the downward extension part 15*b* of the magnetic sheath 15, it is possible to cover only the two areas 11*a*1 sandwiched by the first external terminal ET1 and the second external terminal ET2 with the downward extension part 15*b* of the magnetic sheath 15. In this case, a clearance CL2 shown in FIG. 5 becomes the same as the clearance CL1 shown in FIG. 2.

Embodiment 3

Figure 7:
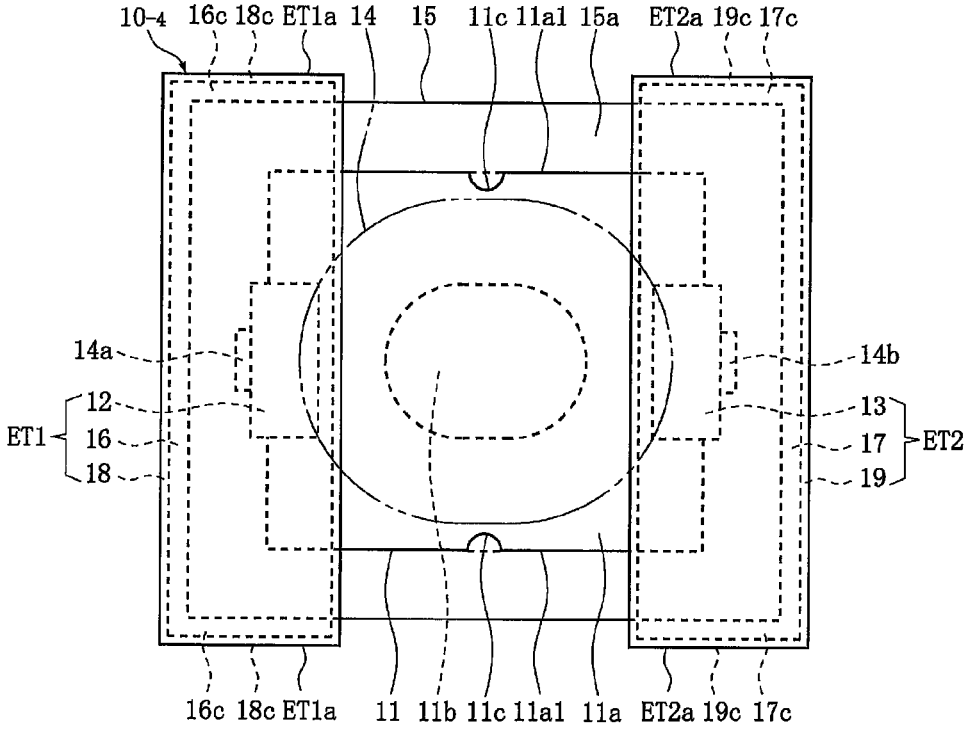
FIG. 7 is an enlarged bottom view, corresponding to FIG. 3, of a coil component to which the present invention is applied (Embodiment 3).

FIG. 7 shows a coil component to which the present invention is applied (Embodiment 3). This coil component 10-3 is different from the coil component 10-1 in Embodiment 1 in that:

Along the outer periphery of the bottom face of the sheet part 11*a* of the magnetic core 11, the two areas 11*a*1 not covered by the first external terminal ET1 and the second external terminal ET2 are partially (at two locations each) covered by a part 15*c* extending downward from the part 15*a* of the magnetic sheath 15 covering the side face of the sheet part 11*a* of the magnetic core 11.

The remainder of the constitution is the same as that of the coil component 10-1 in Embodiment 1 and therefore not explained.

This coil component 10-3 achieves <Effect 8> below in addition to <Effect 1> to <Effect 5> mentioned above.

<Effect 8> By partially (at two locations each) covering, by the downward extension part 15*c* of the magnetic sheath 15 the two areas 11*a*1 not covered by the first external terminal ET1 and the second external terminal ET2 along the outer periphery of the bottom face of the sheet part 11*a* of the magnetic core 11, damage to the locations where the downward extension parts 15*c* are present can be reliably prevented. Even when insulation property drops, as mentioned in <Effect 6> above, in locations where the downward extension parts 15*c* are not present in each area 11*a*1, short-circuiting can also be prevented reliably by preventing damage in locations where the downward extension parts 15*c* are present.

Note that, although a total of four downward extension parts 15*c* are formed at positions near the first external terminal ET1 and the second external terminal ET2 in FIG. 7, it is sufficient to have only one downward extension part 15*c* in each area 11*a*1 and this part can be positioned at any place.

Embodiment 4

Figure 8:
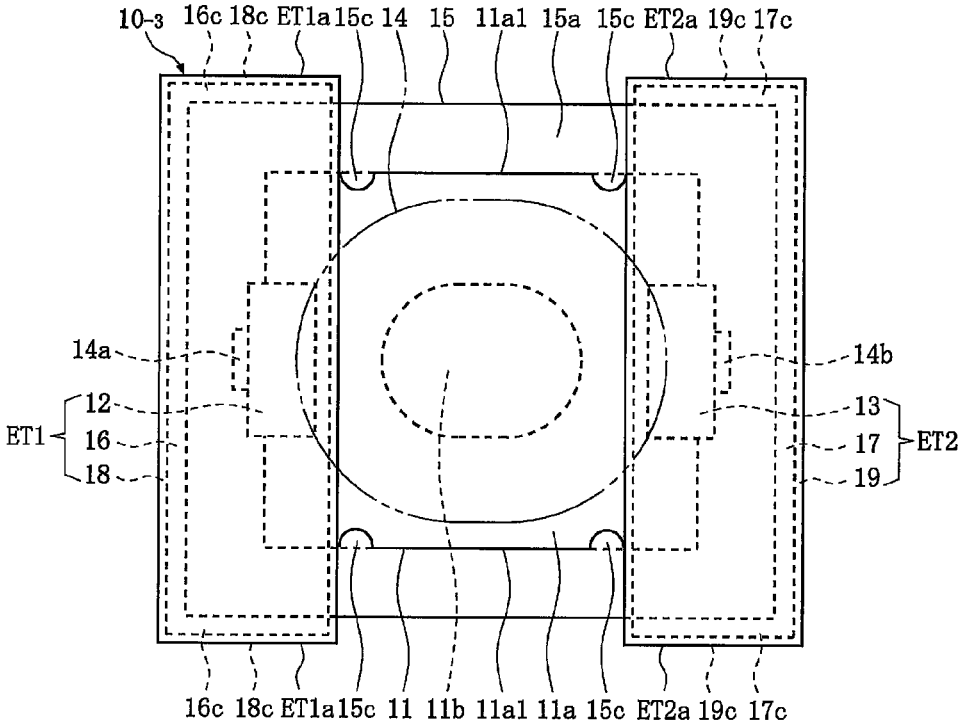
FIG. 8 is an enlarged bottom view, corresponding to FIG. 3, of a coil component to which the present invention is applied (Embodiment 4).

FIG. 8 shows a coil component to which the present invention is applied (Embodiment 4). This coil component 10-4 is different from the coil component 10-1 in Embodiment 1 in that:

A concave part 11*c* is formed that divides each of the two areas 11*a*1 not covered by the first external terminal ET1 and the second external terminal ET2 along the outer periphery of the bottom face of the sheet part 11*a* of the magnetic core 11.

The remainder of the constitution is the same as that of the coil component 10-1 in Embodiment 1 and therefore not explained.

This coil component 10-4 achieves <Effect 9> below in addition to <Effect 1> to <Effect 5> mentioned above.

<Effect 9> By forming the concaved part 11*c* that divides each of the two areas 11*a*1 not covered by the first external terminal ET1 and the second external terminal ET2 along the outer periphery of the bottom face of the sheet part 11*a* of the magnetic core 11, peeling and dropping of the oxide film from the surface of magnetic alloy grains present on the inner surface of each concaved part 11*c* can be reliably prevented. Should each area 11*a*1 be damaged and insulation property drop as mentioned in <Effect 6>, the presence of each concaved part 11*c* allows for reliable prevention of short-circuiting.

Note that, although a total of two concaved parts 11*c* are formed roughly at the center of each area 11*a*1 in FIG. 8, more than two concaved parts 11*c* can be provide in each area 11*a*1 and these parts can have any shape.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species.

The present application claims priority to Japanese Patent Application No. 2011-011213, filed Jan. 21, 2011, the disclosure of which is incorporated herein by reference in its entirety. In some embodiments, as the magnetic core, those disclosed in co-assigned U.S. patent application Ser. No. 13/092,381 and No. 13/277,018 can be used, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component characterized by comprising:

a magnetic core integrally having a sheet part and a pillar part formed on a top face of the sheet part;

a pair of first conductive films formed from a side face to a bottom face of the sheet part of the magnetic core;

a coil integrally having a spiral part where a conductive wire whose cross-section shape is a rectangle having a long side and a short side is spirally wound, and a one end of the conductive wire and an other end of the conductive wire are drawn from the spiral part, wherein the spiral part is placed around the pillar part of the magnetic core, and the long side at the one end of the conductive wire is joined to a surface of the side face of the one first conductive film, while the long side at the other end of the conductive wire is joined to a surface of the side face of the other first conductive film;

a magnetic sheath formed so as to cover each of:

the top face of the pillar part and the side face of the sheet part of the magnetic core, surfaces of the side faces of the first conductive films, and surfaces of the spiral part, one end of the conductive wire, the joined part at the one end of the conductive wire, the other end of the conductive wire and the joined part at the other end of the conductive wire, of the coil;

a pair of second conductive films formed from a side face of the magnetic sheath to a bottom face of the sheet part of the magnetic core, via a bottom face of the magnetic sheath, so that the surfaces of the bottom faces of the first conductive films are covered, respectively; and a pair of third conductive films formed so as to cover surfaces of the respective second conductive films;

wherein the one first conductive film, one second conductive film and one third conductive film constitute a first external terminal, while the other first conductive film, other second conductive film and other third conductive film constitute a second external terminal;

wherein the joined part at the one end of the conductive wire and the joined part at the other end of the conductive wire of the coil are sandwiched by the side faces of the first conductive films and a part of the magnetic sheath covering the side face of the sheet part of the magnetic core, respectively; and wherein the parts of the magnetic sheath covering the surface of the joined part at the one end of the conductive wire and the surface of the joined part at the other end of the conductive wire are sandwiched, with each joined part in between, by the side face of each of the first conductive films and the side face of each of the second conductive films as well as the side face of each of the third conductive films, respectively.

2. A coil component according to claim 1, characterized in that the first conductive films are baked conductive films.

3. A coil component according to claim 1, characterized in that the second conductive films are constituted by metal grains and insulation material present between the metal grains.

4. A coil component according to claim 1, characterized in that the sheet part of the magnetic core has a profile, as viewed from the top, of a rough rectangle and the first conductive films are formed from two opposing side faces to the bottom face of the sheet part, and the magnetic sheath has a profile, as viewed from the top, of a rough rectangle and the second conductive films have width dimensions roughly the same as those of the two side faces of the magnetic sheath corresponding to the two opposing side faces of the sheet part of the magnetic core.

5. A coil component according to claim 4, characterized in that the side faces and bottom faces of the second conductive films are continued via second side faces present on the other two side faces adjacent to the two side faces of the magnetic sheath, and two wraparound parts are formed on the first external terminal and the second external terminal by the second side faces and the second side faces of the third conductive films covering these side faces.

6. A coil component according to claim 1, characterized in that the magnetic core is constituted by magnetic alloy grains, an oxide film of the magnetic alloy grains is formed on a surface of each magnetic alloy grain, and the oxide film binds adjacent magnetic alloy grains.

7. A coil component according to claim 1, characterized in that the magnetic sheath is constituted by magnetic alloy grains and an insulation material present between the magnetic alloy grains, and the insulation material binds adjacent magnetic alloy grains.

8. A coil component according to claim 1, characterized in that the bottom face of the sheet part of the magnetic core is roughly flush with the bottom face of the magnetic sheath.

9. A coil component according to claim 1, characterized in that, along an outer periphery of the bottom face of the sheet part of the magnetic core, two areas not covered by the first external terminal and the second external terminal are entirely covered by a part extending downward from the part of the magnetic sheath covering the side face of the sheet part of the magnetic core.

10. A coil component according to claim 1, characterized in that, along an outer periphery of the bottom face of the sheet part of the magnetic core, two areas not covered by the first external terminal and the second external terminal are partially covered by a part extending downward from the part of the magnetic sheath covering the side face of the sheet part of the magnetic core.

11. A coil component according to claim 1, characterized in that a concave part is formed that divides each of two areas not covered by the first external terminal and the second external terminal along an outer periphery of the bottom face of the sheet part of the magnetic core.

12. A coil component according to claim 2, characterized in that the second conductive films are constituted by metal grains and insulation material present between the metal grains.

13. A coil component according to claim 2, characterized in that the sheet part of the magnetic core has a profile, as viewed from the top, of a rough rectangle and the first conductive films are formed from two opposing side faces to the bottom face of the sheet part, and the magnetic sheath has a profile, as viewed from the top, of a rough rectangle and the second conductive films have width dimensions roughly the same as those of the two side faces of the magnetic sheath corresponding to the two opposing side faces of the sheet part of the magnetic core.

14. A coil component according to claim 3, characterized in that the sheet part of the magnetic core has a profile, as viewed from the top, of a rough rectangle and the first conductive films are formed from two opposing side faces to the bottom face of the sheet part, and the magnetic sheath has a profile, as viewed from the top, of a rough rectangle and the second conductive films have width dimensions roughly the same as those of the two side faces of the magnetic sheath corresponding to the two opposing side faces of the sheet part of the magnetic core.

15. A coil component according to claim 12, characterized in that the sheet part of the magnetic core has a profile, as viewed from the top, of a rough rectangle and the first conductive films are formed from two opposing side faces to the bottom face of the sheet part, and the magnetic sheath has a profile, as viewed from the top, of a rough rectangle and the second conductive films have width dimensions roughly the same as those of the two side faces of the magnetic sheath corresponding to the two opposing side faces of the sheet part of the magnetic core.

16. A coil component according to claim 13, characterized in that the side faces and bottom faces of the second conductive films are continued via second side faces present on the other two side faces adjacent to the two side faces of the magnetic sheath, and two wraparound parts are formed on the first external terminal and the second external terminal by the second side faces and the second side faces of the third conductive films covering these side faces.

17. A coil component according to claim 14, characterized in that the side faces and bottom faces of the second conductive films are continued via second side faces present on the other two side faces adjacent to the two side faces of the magnetic sheath, and two wraparound parts are formed on the first external terminal and the second external terminal by the second side faces and the second side faces of the third conductive films covering these side faces.

18. A coil component according to claim 15, characterized in that the side faces and bottom faces of the second conductive films are continued via second side faces present on the other two side faces adjacent to the two side faces of the magnetic sheath, and two wraparound parts are formed on the first external terminal and the second external terminal by the second side faces and the second side faces of the third conductive films covering these side faces.

* * * * *